US012767312B1

(12) United States Patent
Belter

(10) Patent No.: US 12,767,312 B1
(45) Date of Patent: Oct. 20, 2026

(54) COOLING SYSTEMS FOR MARINE GYROSCOPIC STABILIZERS

(71) Applicant: Brunswick Corporation, Mettawa, IL (US)

(72) Inventor: David J. Belter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 375 days.

(21) Appl. No.: 18/398,257

(22) Filed: Dec. 28, 2023

(51) Int. Cl.

| | |
|---|---|
| ***B63H 20/28*** | (2006.01) |
| ***B63B 39/04*** | (2006.01) |
| ***B63H 21/38*** | (2006.01) |
| ***B63J 3/04*** | (2006.01) |

(52) U.S. Cl.
CPC ..... *B63H 21/383* (2013.01); *B63B 39/04* (2013.01); *B63H 20/28* (2013.01); *B63J 3/04* (2013.01)

(58) Field of Classification Search
CPC ..... B63H 21/00; B63H 21/383; B63H 20/00; B63H 20/28; B63H 11/00; B63B 39/00; B63B 39/04; B63J 3/00; B63J 3/04
USPC ..... 440/88 C, 88 L
See application file for complete search history.

(56) References Cited

U.S. PATENT DOCUMENTS

| | | | | |
|---|---|---|---|---|
| 8,117,930 | B2 | 2/2012 | Adams | |
| 10,794,699 | B2 | 10/2020 | Miocevich | |
| 11,440,629 | B2 | 9/2022 | Peterson | |
| 11,591,052 | B2 | 2/2023 | Sohacki | |
| 11,675,372 | B2 | 6/2023 | Derginer | |
| 2005/0266744 | A1* | 12/2005 | Gardner | B63H 21/14 440/88 C |
| 2007/0157749 | A1 | 7/2007 | Adams | |
| 2008/0303363 | A1 | 12/2008 | Alston | |
| 2014/0245939 | A1 | 9/2014 | Nohara | |

OTHER PUBLICATIONS

Seakeeper, https://www.seakeeper.com/technology/, accessed Dec. 14, 2023, 8 pages.

* cited by examiner

*Primary Examiner* — Lars A Olson
(74) *Attorney, Agent, or Firm* — Andrus Intellectual Property Law, LLP

(57) ABSTRACT

A marine vessel comprises a marine gyroscopic stabilizer and a cooling system configured to cool the marine gyroscopic stabilizer. The cooling system has an open loop circuit, and a pump configured to pump water from a body of water in which the marine vessel is operating through the open loop circuit such that the water cools the marine gyroscopic stabilizer.

20 Claims, 5 Drawing Sheets

COOLING SYSTEMS FOR MARINE GYROSCOPIC STABILIZERS

FIELD

The present disclosure relates to marine gyroscopic stabilizers and cooling systems thereof.

BACKGROUND

The following U.S. Patents are incorporated herein by reference in entirety.

U.S. Pat. No. 11,440,629 discloses a gyroscopic boat roll stabilizer for a boat comprising a gimbal, having a gimbal axis, an enclosure mounted to the gimbal and configured to precess about a gimbal axis, a flywheel assembly rotatably mounted inside the enclosure for generating a torque that is applied to counter a rolling motion of the boat, and a braking system for controlling precession of the enclosure. The braking system is configured to enable precession in the first and second directions of up to at least 45 degrees.

U.S. Pat. No. 11,591,052 discloses a gyroscopic roll stabilizer having an enclosure, a flywheel assembly, a bearing, a motor, and a bearing cooling circuit. The enclosure is mounted to a gimbal for rotation about a gimbal axis and configured to maintain a below-ambient pressure. The flywheel assembly includes a flywheel and flywheel shaft. The bearing rotatably mounts the flywheel assembly inside the enclosure for rotation about a flywheel axis. The bearing has an inner race and an outer race. The inner race is affixed to the flywheel shaft, and the outer race is held rotationally fixed relative to the enclosure. The motor is operative to rotate the flywheel assembly. The bearing cooling circuit is configured to transfer heat away from the bearing by recirculating cooling fluid along a closed fluid pathway. The gyroscopic roll stabilizer is configured to transfer heat away from the inner and/or outer race of the bearing to the cooling fluid.

U.S. Pat. No. 11,675,372 discloses a method of controlling attitude of a marine vessel including identifying a natural roll frequency of the marine vessel, measuring a roll motion of the marine vessel with an attitude sensor, and determining that the roll motion exceeds the threshold roll where no corresponding steering input is present. The method can further include determining a counteracting drive movement for at least one propulsion device based on the measured roll motion and the natural roll frequency of the marine vessel. A steering actuator is then controlled to move the at least one propulsion device to effectuate the counteracting drive movement so as to counteract an environmentally-induced roll motion of the marine vessel.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a marine vessel comprises a marine gyroscopic stabilizer and a cooling system configured to cool the marine gyroscopic stabilizer. The cooling system has an open loop circuit, and a pump configured to pump water from a body of water in which the marine vessel is operating through the open loop circuit such that the water cools the marine gyroscopic stabilizer.

Optionally, the marine gyroscopic stabilizer has a cooling section through which the water flows to cool the marine gyroscopic stabilizer, and the cooling section is configured to facilitate draining the water therefrom. Optionally, the cooling section has a sloped surface configured to facilitate draining of the water from the marine gyroscopic stabilizer. Optionally, the cooling section is a first cooling section, and the marine gyroscopic stabilizer has a second cooling section separate from the first cooling section through which the water flows to cool the marine gyroscopic stabilizer. The second cooling section is configured to facilitate draining the water therefrom. Optionally, the second cooling section is located downstream from the first cooling section such that the water passes through the first cooling section before passing through the second cooling section. Optionally, the marine gyroscopic stabilizer has a first flywheel bearing and a second flywheel bearing and the first cooling section is configured to receive heat from the first flywheel bearing and the second cooling section is configured to receive heat from the second flywheel bearing. Optionally, the pump is configured to pump the water back to the body of water. Optionally, the pump is a first pump and the cooling system further comprises a second pump that is configured to pump the water back to the body of water. Optionally, the first pump is located upstream of the marine gyroscopic stabilizer and the second pump is located downstream of the marine gyroscopic stabilizer. Optionally, the pump is configured to pump the water into a reservoir after the water cools the marine gyroscopic stabilizer. Optionally, the pump is a first pump and the cooling system further comprises a second pump that is configured to pump the water in the reservoir back to the body of water. Optionally, the cooling system comprises a tell-tale outlet configured to dispense water from the open loop circuit above a waterline of the body of water to visually indicate operation of the pump. Optionally, the cooling system comprises a drain outlet configured to facilitate draining of the water from the cooling system.

In non-limiting examples, a method for cooling a marine gyroscopic stabilizer of a marine vessel includes mounting the marine gyroscopic stabilizer to the marine vessel, pumping water from a body of water in which the marine vessel is operating through an open loop circuit that extends through the marine gyroscopic stabilizer, and exchanging heat between the marine gyroscopic stabilizer and the water passing through the open loop circuit.

Optionally, the method includes draining the water from the marine gyroscopic stabilizer. Optionally, the method includes routing the open loop circuit through a cooling section of the marine gyroscopic stabilizer which is configured to exchange heat with a flywheel bearing for rotatably mounting a flywheel assembly of the marine gyroscopic stabilizer. Optionally, the method includes routing the open loop circuit through a second cooling section of the marine gyroscopic stabilizer which is configured to exchange heat with a second flywheel bearing for rotatably mounting the flywheel assembly of the marine gyroscopic stabilizer. Optionally, the second cooling section is located downstream from the first cooling section such that the water passes through the first cooling section before passing through the second cooling section. Optionally, the method includes pumping the water to a reservoir after the water cools the marine gyroscopic stabilizer. Optionally, the method includes pumping the water in the reservoir back to the body of water.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present disclosure generally relates to marine gyroscopic stabilizers and cooling systems for cooling one or more components of the marine gyroscopic stabilizers. As will be discussed further below, the cooling systems are operable to transfer thermal energy (e.g., cool) from the marine gyroscopic stabilizer which is mounted to the marine vessel. The cooling systems utilize water from the body of water in which the marine vessel is operating to cool the marine gyroscopic stabilizer. The warmed water is then returned to the body of water. As such, the body of water acts as a heat sink.

Convention marine vessels (e.g., boats, yachts) employ stabilization devices, such as marine gyroscopic stabilizers and/or fin stabilizers, to reduce environmentally-induced disturbances, e.g., waves, wakes, and/or wind, that act on the marine vessel. For example, waves hitting a marine vessel induce rocking or rolling of the marine vessel which may result in undesirable and/or uncomfortable motion of the marine vessel. The stabilization devices are configured to counteract the undesirable motion and thereby increase comfort of occupants on the marine vessel.

Conventional fin stabilizers generally extend from the hull of the marine vessel to counteract waves affecting the marine vessel. However, these fin stabilizers are susceptible to damage. Fin stabilizers may also require actuators and/or mechanical components which are subject to maintenance, repair, and/or replacement considerations. Conventional marine gyroscopic stabilizers are mounted to the deck or hull of the marine vessel and are configured to spin a flywheel at high speeds to thereby counteract or suppress the rolling motion of the marine vessel.

The use of marine gyroscopic stabilizers is increasing in the industry, and the present inventor recognized that the marine gyroscopic stabilizers generate excess heat as the marine gyroscopic stabilizer are operated (described further herein). Through research and experimentation, the present inventor arrived at the marine gyroscopic stabilizers and cooling systems of the present disclosure that utilize the water from the body of water in which marine vessel is operating to cool the marine gyroscopic stabilizer. Furthermore, the present inventor endeavored to provide marine gyroscopic stabilizers and cooling systems that are simpler, lower cost, reduce the electrical energy necessary to cool the marine gyroscopic stabilizer, and/or eliminate the use of potentially environmentally harmful cooling fluid (e.g., glycol), in comparison to conventional cooling systems and conventional marine gyroscopic stabilizers. Accordingly, the present inventor invented the example marine gyroscopic stabilizers and cooling systems described herein below.

Figure 1:
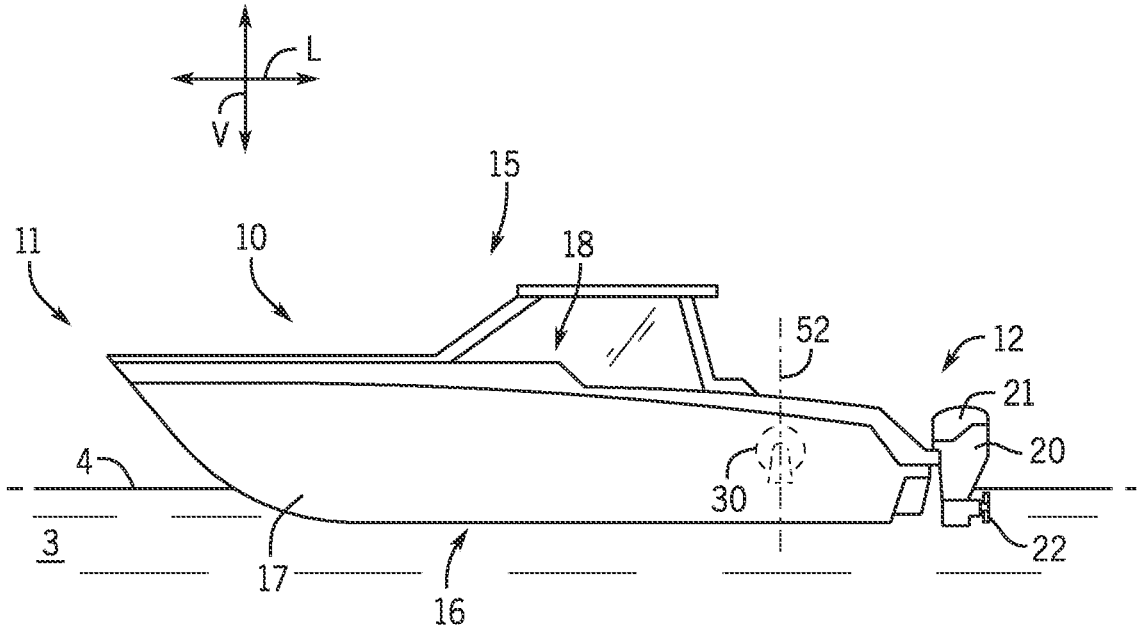
FIG. 1 is a side view of an example marine vessel according to the present disclosure.
Figure 2:
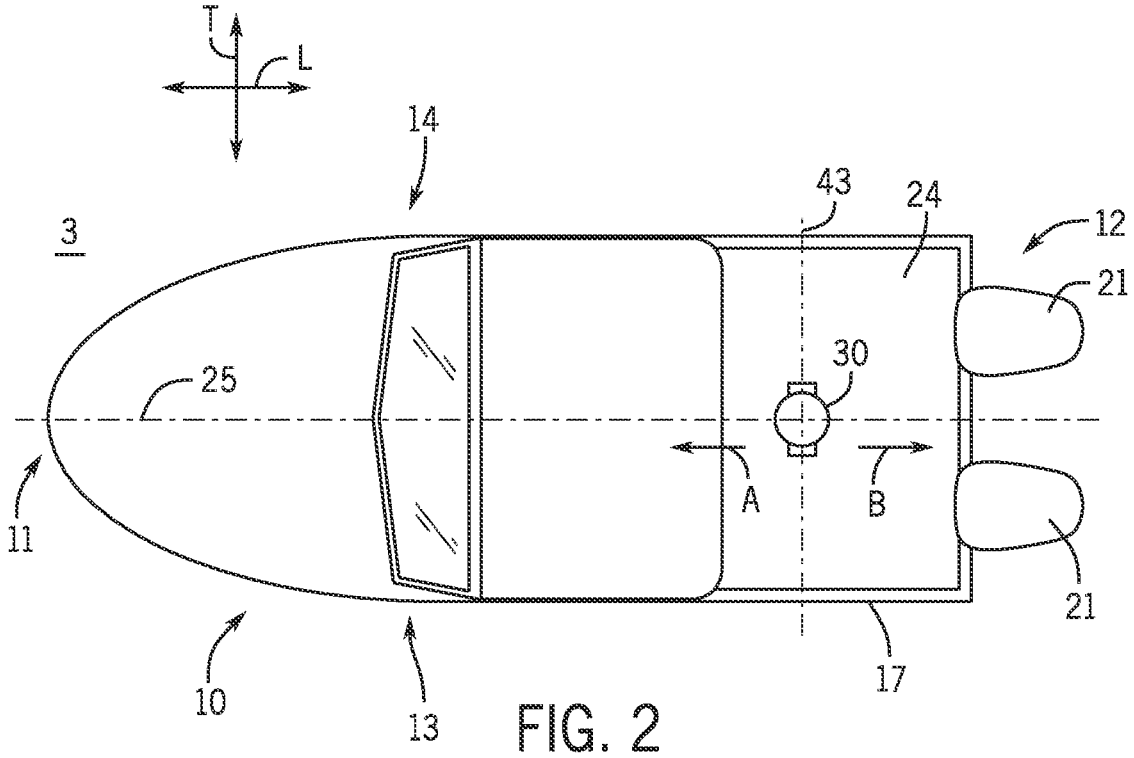
FIG. 2 is a top-down plan view of the marine vessel of FIG. 1.

FIGS. 1-2 depict an example marine vessel 10 according to the present disclosure. The marine vessel 10 longitudinally extends between a bow 11 and a stern 12 (see example longitudinal axis L) and transversely extends between a port side 13 and starboard side 14 (see example transverse axis T which is perpendicular to the longitudinal axis L). Note that the transverse axis T and the longitudinal axis L are each also perpendicular to an example vertical axis V, and the marine vessel 10 has a top side 15 and a bottom side 16. The marine vessel 10 is propelled through a body of water 3 by one or more marine propulsion devices 20, which while depicted in FIGS. 1-2 as outboard motors could also be inboard motors, stern drives, pod drives, and/or jet drives and/or the like. Each marine propulsion device 20 includes a powerhead 21. The powerheads 21 can include internal combustion engines (e.g., gasoline or diesel engines), electric motors, and/or hybrids thereof and/or the like. The powerhead 21 can include electrical power systems (not depicted) in the case of electric or hybrid powerheads. The power system may include batteries and/or other power storage devices, chargers, inverters (e.g., DC-AC inverters, AC-DC inverters), converters (e.g., DC-DC converters), and power distribution systems.

A propeller 22 is coupled in a torque-transmitting relationship with each powerhead 21 to generate propulsion in the water. The rotational engagement between the powerhead 21 and the propeller 22 is provided through a multi-speed transmission and/or gearsets (not depicted). The illustrated example is not limiting, and in other examples the marine propulsion devices 20 may comprise multiple propellers or one or more impellers, and/or the like. Steering actuators (not depicted) are operable to steer the marine propulsion devices 20 in accordance with commands from a steering input device such as a steering wheel. Similarly, trim actuators (not depicted) are operable to adjust a trim angle for each of the marine propulsion devices 20 in a manner known in the art.

The marine vessel 10 includes a helm 18 having one or more operator input devices for controlling various components of the marine vessel 10, including a marine gyroscopic stabilizer and/or a cooling system therefor, as further described herein below. The operator input devices at the helm 18 may include, for example, a multi-functional display device having a user interface, such as an interactive, touch-capable display screen, a keypad, a display screen and keypad combination, and/or any other interfaces known in the art. The operator input devices can further include one or more steering devices, such as the steering wheel and/or a joystick, configured to facilitate user input for steering the marine vessel 10. In certain examples, a throttle lever (not depicted) is also provided as an operator input device for providing thrust commands to the control system 100.

A marine gyroscopic stabilizer 30 is mounted to the deck 24 (or the hull 17) of the marine vessel 10. The marine gyroscopic stabilizer 30 is configured to counteract or suppress the rolling motion of the marine vessel 10 caused by environmental forces (e.g., waves) acting on the marine vessel 10. Examples of conventional marine gyroscopic stabilizers are disclosed in above-incorporated U.S. Pat. Nos. 11,440,629 and 11,591,052. Note that one or more features or components of the example marine gyroscopic stabilizers disclosed in U.S. Pat. Nos. 11,440,629 and 11,591,052, may be incorporated or utilized with the example marine gyroscopic stabilizers 30 of the present disclosure.

Figure 3:
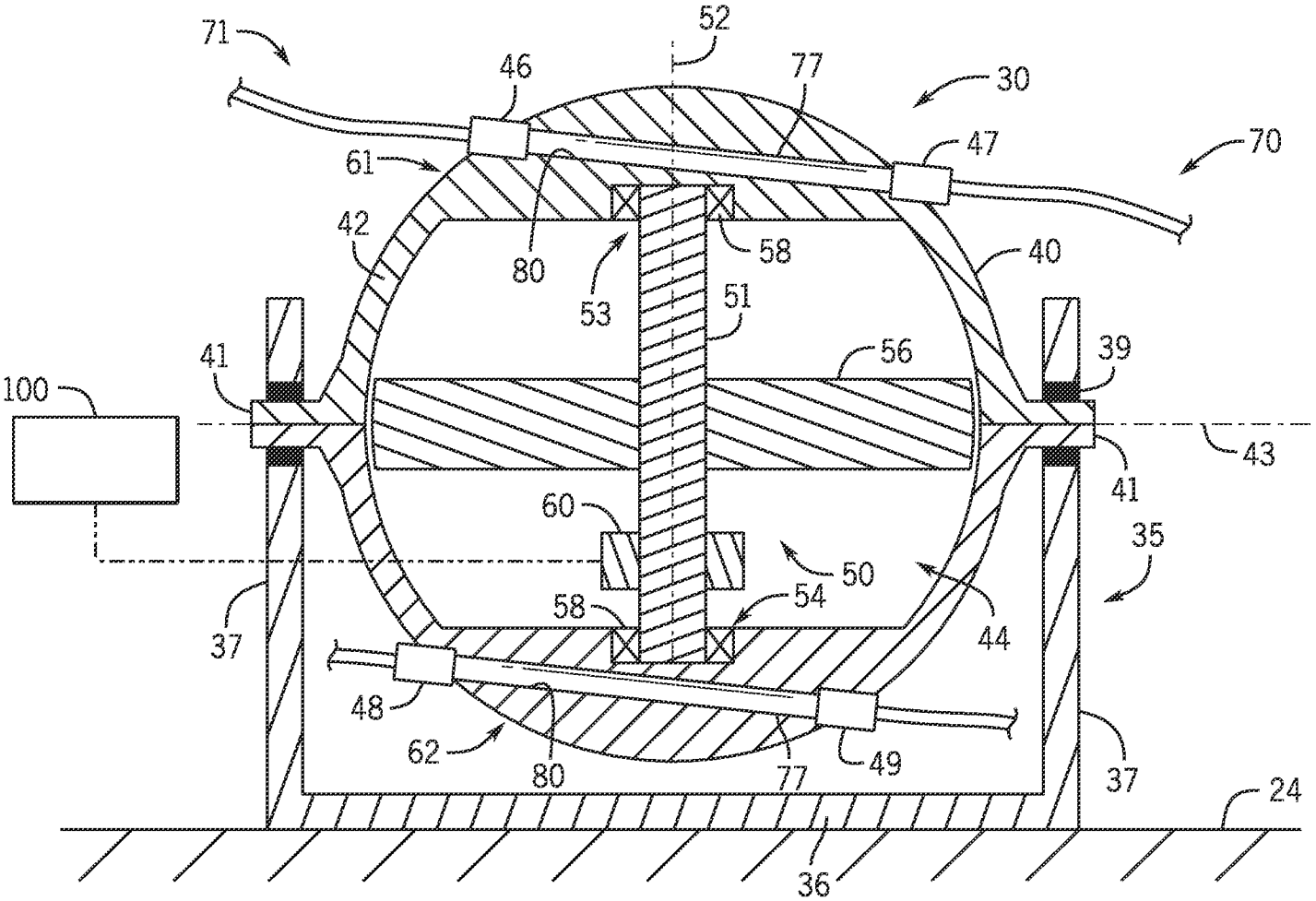
FIG. 3 is a cross-sectional view of an example marine gyroscopic stabilizer according to the present disclosure.

Turning now to FIG. 3, an example marine gyroscopic stabilizer 30 of the present disclosure is depicted in greater detail. The marine gyroscopic stabilizer 30 has a frame 35 mounted to the marine vessel 10. The frame 35 can be mounted to any portion of the marine vessel 10, such as the deck 24 or the hull 17 (FIG. 2), and at any location. The frame 35 has a base 36 and a pair of arms 37 extending therefrom. The arms 37 support one or more arm bearings 39 thereon.

The marine gyroscopic stabilizer 30 has a housing 40 rotatably supported on the arms 37. Specifically, shafts 41 extend outwardly from a main body 42 of the housing 40. The shafts 41 extend from opposite sides of the main body 42. The shafts 41 axially extend along a housing axis 43, and the shafts 41 engage with the arm bearings 39. The housing 40 is capable of rotating about the housing axis 43 which is perpendicular to the forward and aft directions (see arrows A and B on FIG. 2) during operation of the marine gyroscopic stabilizer 30 (described further herein).

The housing 40 defines a chamber 44 therein in which the flywheel assembly 50 (described herein) is located. The chamber 44 can be sealed to maintain a below-ambient air pressure therein. The below-ambient air pressure feature reduces aerodynamic drag on the flywheel assembly 50.

The housing 40 has a pair of opposing cooling sections 61, 62 located on opposite ends of the main body 42. Note that in the example depicted in FIG. 3, the cooling sections 61, 62 are exterior of the chamber 44 and contained within the main body 42 of the housing 40. Note that in other examples, the cooling sections 61, 62 are located in or are part of the chamber 44. In still other examples, the cooling sections 61, 62 are mounted on the exterior surface of the main body 42.

The flywheel assembly 50 includes a flywheel shaft 51 extending in the chamber 44 along a flywheel axis 52. The flywheel shaft 51 has opposing ends, namely a first shaft end 53 and a second shaft end 54, which are coupled to the housing 40 via flywheel bearings 58. The flywheel bearings 58 are fixed to the main body 42 of the housing 40, and the flywheel bearings 58 permit rotation of the flywheel shaft 51 about the flywheel axis 52. The flywheel axis 52 is perpendicular to the housing axis 43. As a matter of example, when the marine vessel 10 is level, the flywheel axis 52 vertically extends and the housing axis 43 laterally extends. Seals (not depicted) can be coupled to the flywheel bearings 58 to contain lubricating fluid in the flywheel bearings 58.

A motor 60 rotates or spins the flywheel shaft 51 about flywheel axis 52. As such, the flywheel shaft 51 rotates a flywheel 56, and the motor 60 rotates the flywheel assembly 50 at a high rate of speed (e.g., 7000 rotations per minute (rpm), 6000-1000 rpm). The motor 60 is secured to the main body 42 of the housing. In certain examples, the motor 60 has a stator (not depicted) that is coupled to the interior surface or the exterior surface of the main body 42. The motor 60 is powered by AC or DC power.

Generally, marine gyroscopic stabilizers 30 are configured to suppress undesirable roll motions of the marine vessel 10 by producing a stabilizing torque through controlled precession of stored angular momentum of the spinning flywheel 56. Conservation of the angular momentum of the flywheel 56 causes the flywheel 56 to precess about the housing axis 43 that is laterally oriented relative to the marine vessel 10 and perpendicular to the flywheel axis 52. By controlling the precession rate about the housing axis 43, a control torque about the longitudinal centerline 25 (FIG. 2) of the marine vessel 10 is induced that is directly proportional to the flywheel rotational moment of inertia about the flywheel axis 52, the angular velocity of the flywheel assembly 50, and the precession rate about the housing axis 43. The direction of the control torque opposes the direction of roll torque, thereby dampening any roll motion induced by the roll torque. As such, the marine gyroscopic stabilizer 30 'stabilizes' the marine vessel 10 and increases the comfort of the occupants.

In non-limiting examples, during operation of the marine gyroscopic stabilizer 30 the marine gyroscopic stabilizer 30 rotates the flywheel assembly 50, which generates energy in the form of angular momentum. This energy is utilized to counteract the rolling motion of the marine vessel 10. As environmental forces affect the marine vessel 10, the marine vessel 10 'rolls' causing the flywheel 56 to precess about the housing axis 43. A control system 100 (FIG. 3) is in communication with sensors e.g., roll sensors, that sense the roll rate and/or the roll angle of the marine vessel 10 and the control system 100 controls the motor 60 and one or more torque applying devices (not depicted) that are configured to control the rate of precession of the flywheel assembly 50. As such, the precession of the flywheel assembly 50 generates a torque opposite the rolling motion of the marine vessel 10 to thereby counteract or dampen the rolling motion of the marine vessel 10.

Spinning the flywheel shaft 51 and/or the flywheel 56 generates heat caused, for example, by friction forces between the flywheel shaft 51 and the flywheel bearings 58 and/or the motor 60. Excess amounts of heat in the marine gyroscopic stabilizer 30 can lead to failure of the flywheel bearings 58, the motor 60, and/or other components of the marine gyroscopic stabilizer 30. As such, it is advantageous to remove excess heat from the marine gyroscopic stabilizer 30. Example cooling systems 70 of the present disclosure for cooling the marine gyroscopic stabilizer 30 and/or components thereof are described herein below.

Figure 4:
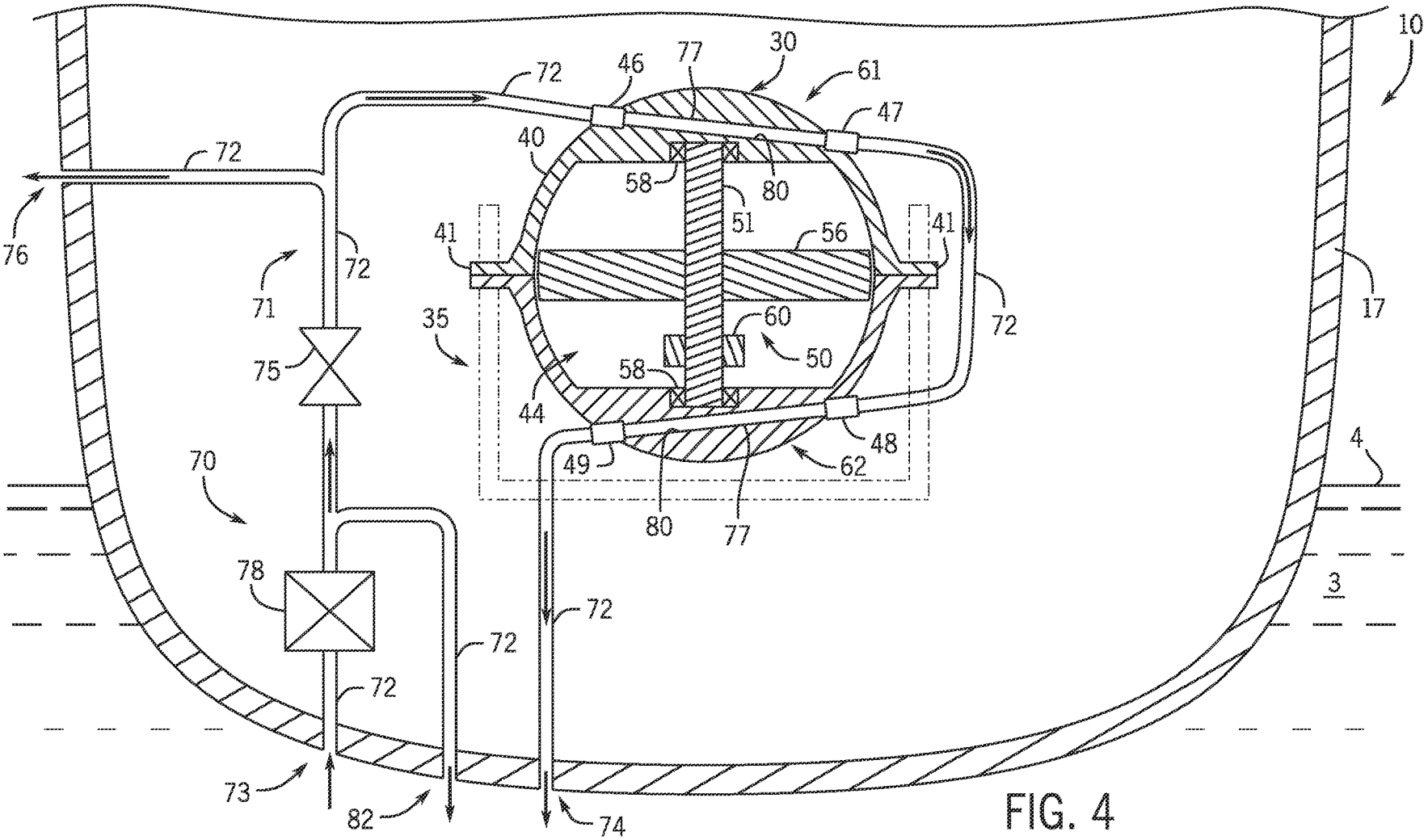
FIG. 4 is a schematic view of an example cooling system for a marine gyroscopic stabilizer according to the present disclosure.

Referring now to FIG. 4, an example cooling system 70 configured to cool the marine gyroscopic stabilizer 30 is depicted. The cooling system 70 includes an open loop circuit 71 that extends via conduits 72 between a water inlet 73 and a water outlet 74. The water inlet 73 is positioned to draw water from the body of water 3 into the open loop circuit 71. The water outlet 74 is positioned to return the water from the open loop circuit 71 back to the body of water 3. The conduits 72 may be one or combinations of hoses, pipes, through-holes, channels, and/or passages through certain components (such as heat exchangers). In certain examples, the water inlet 73 and/or the water outlet 74 are provided as through-holes in the hull 17 of the marine vessel 10. In certain examples, the open loop circuit 71 passes through the marine gyroscopic stabilizer 30.

A pump 78 is fluidly coupled to the open loop circuit 71 and pumps the water from the body of water 3 through the water inlet 73 and through the open loop circuit 71, and/or back to the body of water 3 via the water outlet 74. As such, the water passing through the open loop circuit 71 cools the marine gyroscopic stabilizer 30. Optionally, a valve 75 is coupled to the open loop circuit 71 and is selectively opened to permit the water to be pumped through the open loop circuit 71 to the marine gyroscopic stabilizer 30. The pump 78 is located upstream of the marine gyroscopic stabilizer 30 in the open loop circuit 71.

The open loop circuit 71 optionally includes a tell-tale outlet 76 through which water dispenses when the pump 78 is 'on' and pumping water through the open loop circuit 71.

The water dispensing through the tell-tale outlet 76 is a visual indicator to the operator that the pump 78 is pumping the water through the open loop circuit 71. The tell-tale outlet 76 also advantageously permits entry of the air into the open loop circuit 71 to facilitate draining of the open loop circuit 71.

The open loop circuit 71 optionally includes a drain outlet 82 through which water dispenses when the pump 78 is both on and off. When the pump is off, water remaining in the open loop circuit 71 can drain from the open loop circuit 71 thereby reducing the risk of the water corroding and/or damaging components of the cooling system 70 (e.g., the valve 75, conduits 72) and/or the marine gyroscopic stabilizer 30. In certain examples, the pump 78 permits water to backflow therethrough such that the water dispenses through the water inlet 73 when the pump is off.

The open loop circuit 71 extends through an upper, first housing inlet 46, through an upper first cooling section 61, and through an upper, first housing outlet 47. As such, the water passing through the open loop circuit 71 and the first cooling section 61 cools the marine gyroscopic stabilizer 30 and/or components thereof.

In non-limiting examples, the first cooling section 61 defines the cooling passage 77 through which the water passes between the first housing inlet 46 and the first housing outlet 47. The first cooling section 61 is configured to automatically drain the water therefrom. In some examples, the first cooling section 61 is configured to facilitate draining of the water from the cooling passage 77 and/or the first cooling section 61. For example, the first cooling section 61 is designed to leverage the force of gravity acting on the water such that the force of gravity causes the water to drain from the first cooling section 61. In non-limiting examples, the first cooling section 61 has a sloped surface 80 that at least partially defines the cooling passage 77. The sloped surface 80 is configured to facilitate the draining of the water from the first cooling section 61 to reduce the risk of water corroding and/or damaging components of the marine gyroscopic stabilizer 30. In certain examples, a strainer (not depicted) is coupled to the open loop circuit 71 and is configured to strain debris and/or large particles from the water to thereby prevent clogging of the open loop circuit 71. The strainer can be located at any suitable location in the open loop circuit 71 such as upstream or downstream of the pump 78.

The first cooling section 61 can include any suitable features or components for facilitating or receiving heat from the flywheel bearings 58 and/or the chamber 44. The heat may be transferred to the first cooling section 61 via solid conduction and/or liquid conduction. For example, the first cooling section 61 may be a solid mass (e.g., metal) with the cooling passage 77 extending therethrough such that the heat transfers from the flywheel bearings 58 and/or the chamber 44 through the solid mass to the water in the cooling passage 77. In other examples, the first cooling section 61 may include a heat conductor component (not depicted; e.g., solid metal plate) that is adjacent to the flywheel bearing 58 and/or the chamber 44 such that the heat is transferred through the heat conductor component to the water passing through the first cooling section 61 and/or the cooling passage 77. In other examples, the first cooling section 61 contains a heat transfer fluid that facilitates the transfer of heat from the flywheel bearing 58 and/or the chamber 44 to the water passing through the first cooling section 61 and/or the cooling passage 77.

The open loop circuit 71 also extends through a lower second housing inlet 48, a lower second cooling section 62, and through a lower second housing outlet 49. The water passing through the second cooling section 62 also cools the marine gyroscopic stabilizer 30 and/or components thereof. The lower second cooling section 62 can include any of the features or components of the upper first cooling section 61. Similarly, the upper first cooling section 61 can include any of the features or components of the lower second cooling section 62.

Note that in other examples, the open loop circuit 71 extends through only the first cooling section 61. In these examples, the cooling system 70 may include a separate, second open loop circuit (not depicted) that extends through the second cooling section 62 to cool the marine gyroscopic stabilizer 30.

In the example depicted in FIG. 4, a conduit 72 extends between the first housing outlet 47 and the second housing inlet 48. As such, the water flows in 'series' from the first cooling section 61 to the second cooling section 62. As such, the second cooling section 62 is located downstream from the first cooling section 61 along the open loop circuit 71 such that the water passes through the first cooling section 61 before passing through the second cooling section 62.

In other examples, the open loop circuit 71 extends through the second cooling section 62 via a conduit 72 separate from the conduit 72 leading to the first cooling section 61. In these examples, the cooling system 70 is configured to convey water in parallel paths to each of the cooling sections 61, 62 and the water paths may be recombined downstream from the housing outlets 47, 49.

In the example depicted in FIG. 4, the first housing inlet 46 is located on the opposite side of the main body 42 relative to the second housing inlet 48. As such the sloped surfaces 80 of the cooling section 61, 62 are oriented in generally opposite directions (e.g., the sloped surface 80 of the first cooling section 61 causes the water to drain to one side of the marine gyroscopic stabilizer 30 while the sloped surface 80 of the second cooling section 62 causes the water to drain to the other side of the marine gyroscopic stabilizer 30). In other examples (see FIG. 3), the first housing inlet 46 is located on the same side of the main body 42 as the second housing inlet 48. As such, the sloped surfaces 80 are oriented in generally the same direction. In some examples, the housing inlets 46, 48 are vertically offset above their respective housing outlets 47, 49 such that the sloped surfaces 80 are sloped toward the housing outlets 47, 49.

Figure 5:
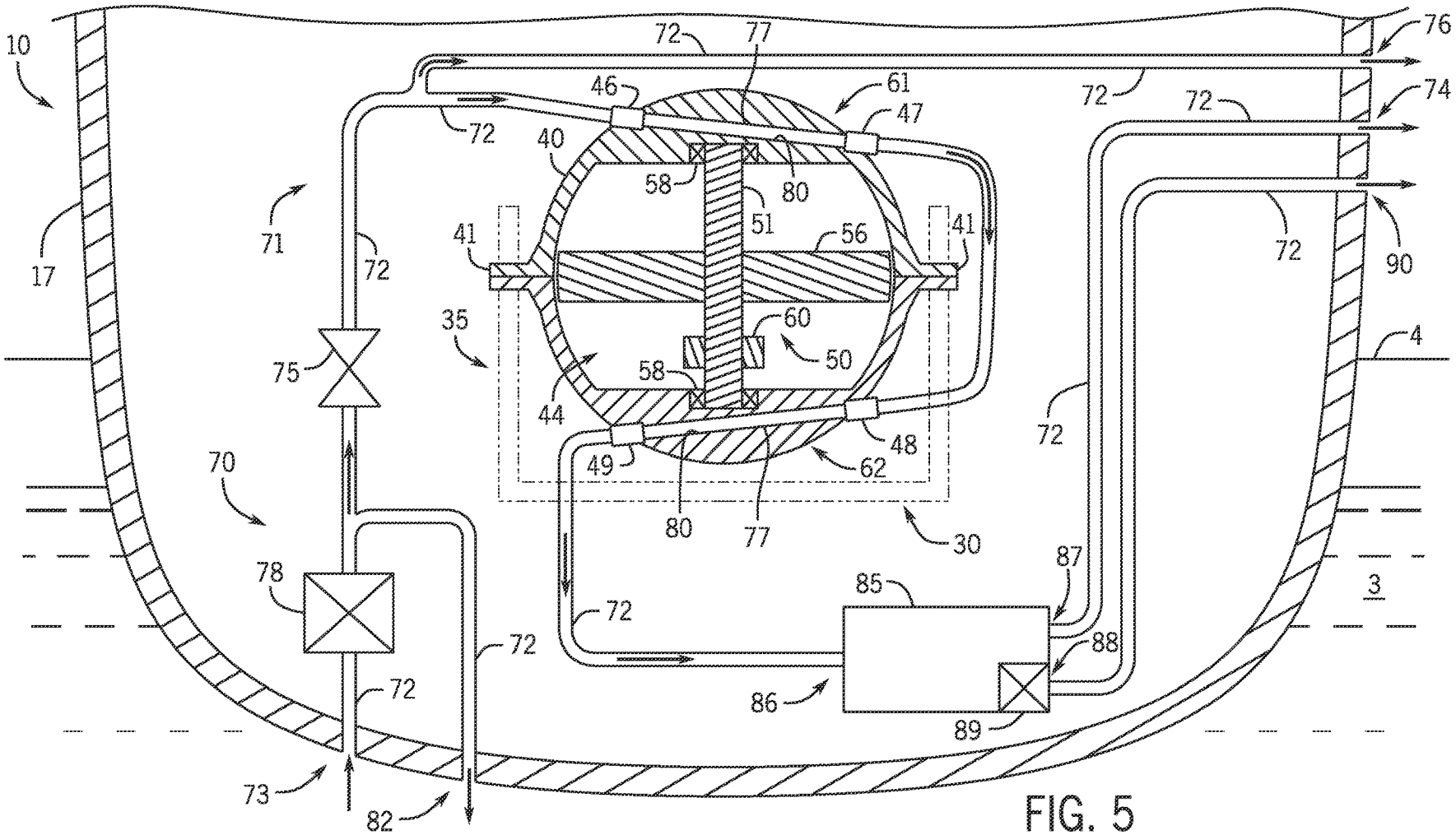
FIG. 5 is a schematic view of another example cooling system for a marine gyroscopic stabilizer according to the present disclosure.

Referring now to FIG. 5, another example cooling system 70 configured to cool the marine gyroscopic stabilizer 30 is depicted. The cooling system 70 depicted in FIG. 5 can include one or more features and/or components described with reference to the cooling system 70 depicted in FIG. 4. Similarly, the cooling system 70 described with reference to FIG. 4 can include any features and/or components described with reference to the cooling system 70 described below with respect to FIG. 5. Note that components indicated on FIG. 5 that are similar to the components indicated on FIG. 4 are denoted with the same part numbers, however, it should be understood that the use of the same part numbers for systems and/or components of the present disclosure should not be construed to indicate that the similarly marked systems and/or components are necessarily identical. The similarly marked systems and/or components may have varying features or characteristics relative to each other. For instance, the pump 78 depicted in FIG. 5 may be configured to have a different flow rate, motor, and/or the like relative to the pump 78 depicted in FIG. 4.

The cooling system 70 depicted in FIG. 5 includes a reservoir 85 fluidly coupled to the open loop circuit 71 and configured to receive water exiting the marine gyroscopic stabilizer 30. The reservoir 85 is positioned downstream and vertically below of the cooling sections 61, 62. The water received into the reservoir 85 is relatively warmer than the water in the body of water 3. In certain examples, the marine vessel 10 includes a thermal management system (not depicted) for transferring heat from the water in the reservoir 85 to another component of the marine vessel 10 (e.g., potable water heater, maintaining a minimum temperature of a battery). In these examples, the heat removed from the marine gyroscopic stabilizer 30 can be utilized by the marine vessel 10 thereby increasing the energy efficiency of the marine vessel 10 (e.g., the marine vessel 10 uses the heat from the marine gyroscopic stabilizer 30 to heat potable water in the water heater thereby reducing the electrical energy needed to heat the potable water to the desired temperature).

The reservoir 85 has a reservoir inlet 86 configured to receive the water from the one or more of the cooling sections 61, 62. When the pump 78 is 'on' and operating to pump water through the open loop circuit 71, the water received into the reservoir 85 passes out of the reservoir 85 via a first reservoir outlet 87. The water flows through the conduit 72 to the water outlet 74. When the pump 78 is 'off' and thereby not pumping water through the open loop circuit 71 any water remaining in the reservoir 85 and/or any water that drains out of the cooling sections 61, 62 to the reservoir 85 is pumped out of the reservoir 85 by a second pump 89. The second pump 89 pumps the water out of the reservoir 85 via a second reservoir outlet 88 through a conduit 72 and out of the marine vessel 10 via a secondary outlet 90. The second pump 89 can be operated by the control system 100 (FIG. 3), and the control system 100 may operate the second pump 89 after controlling the first pump 78 to cease pumping of the water through the open loop circuit 71 and/or in response to water sensors or water level sensors configured to detect water in the reservoir 85. The second pump 89 is located downstream of the marine gyroscopic stabilizer 30 in the open loop circuit 71. In certain examples, the open loop circuit 71, such as the open loop circuit 71 depicted in FIG. 4, is configured to drain the water from the marine gyroscopic stabilizer 30 down to the waterline 4 of the body of water 3. In other examples, the open loop circuit 71, such as the open loop circuit 71 depicted in FIG. 5, is configured to drain water from the marine gyroscopic stabilizer 30 even if the marine gyroscopic stabilizer 30 is positioned below the waterline 4

Figure 6:
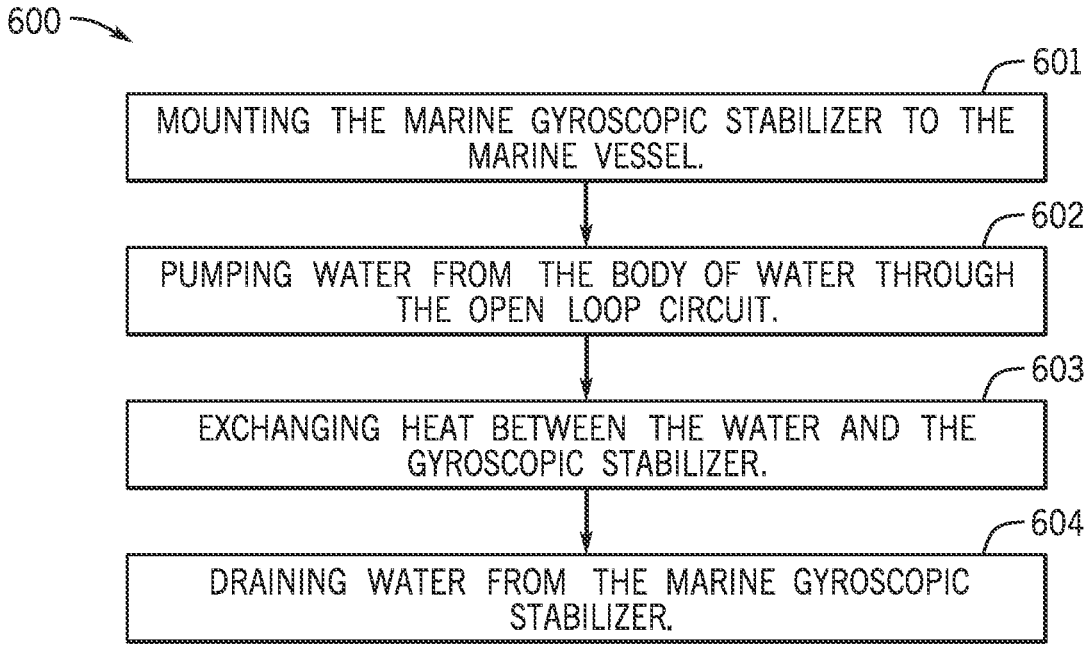
FIG. 6 is a flow chart depicting an example method for cooling a marine gyroscopic stabilizer according to the present disclosure.

FIG. 6 illustrates an example method 600 for cooling marine gyroscopic stabilizers 30 according to the present disclosure. The method is described as a series of logic steps. Furthermore, the present disclosure contemplates other example methods that include combinations of individual or multiple steps from any of the methods described herein below. Note that the method 600 may be understood with reference to components depicted in FIG. 4.

The method 600 begins at step 601 with mounting the marine gyroscopic stabilizer 30 to the deck or the hull of the marine vessel 10. In this example, the bottom of the marine gyroscopic stabilizer 30 is above the waterline 4 of the body of water 3. The pump 78 is configured to pump the water from the body of water 3 in which the marine vessel 10 is operating through the open loop circuit 71 of the cooling system 70 at step 602. At step 603 the water pumped through the open loop circuit 71 exchanges heat with the marine gyroscopic stabilizer 30. Optionally at step 604, the water is drained from the marine gyroscopic stabilizer 30. Optionally, the open loop circuit 71 is routed through the one or more cooling sections 61, 62 which, as noted above, are configured to exchange heat with the marine gyroscopic stabilizer 30 (e.g., exchange heat with the flywheel bearings 58 that rotatably mount the flywheel assembly 50 of the marine gyroscopic stabilizer 30). Optionally, in the case where the bottom of the marine gyroscopic stabilizer 30 is below the waterline 4, the method 600 includes pumping the water with the pump 78 to the reservoir 85 (FIG. 5) after the water cools the marine gyroscopic stabilizer 30. Optionally, the method 600 includes pumping the water with the second pump 89 in the reservoir 85 (FIG. 5) back to the body of water 3.

It will thus be understood that the present disclosure provides examples of a marine vessel comprising a marine gyroscopic stabilizer having a frame mounted to the marine vessel, a housing mounted to the frame and defining a chamber therein, and a flywheel assembly in the chamber and mounted on the housing with a bearing. A novel cooling system is configured to cool the marine gyroscopic stabilizer. The cooling system has an open loop circuit and a pump configured to pump water from a body of water in which the marine vessel is operating through the open loop circuit such that the water cools the marine gyroscopic stabilizer.

In non-limiting examples, a marine vessel comprises a marine gyroscopic stabilizer and a cooling system configured to cool the marine gyroscopic stabilizer. The cooling system has an open loop circuit, and a pump configured to pump water from a body of water in which the marine vessel is operating through the open loop circuit such that the water cools the marine gyroscopic stabilizer.

Optionally, the marine gyroscopic stabilizer has a cooling section through which the water flows to cool the marine gyroscopic stabilizer, and the cooling section is configured to facilitate draining the water therefrom. Optionally, the cooling section has a sloped surface configured to facilitate draining of the water from the marine gyroscopic stabilizer. Optionally, the cooling section is a first cooling section, and the marine gyroscopic stabilizer has a second cooling section separate from the first cooling section through which the water flows to cool the marine gyroscopic stabilizer. The second cooling section is configured to facilitate draining of the water therefrom. Optionally, the second cooling section is located downstream from the first cooling section such that the water passes through the first cooling section before passing through the second cooling section. Optionally, the marine gyroscopic stabilizer has a first flywheel bearing and a second flywheel bearing and the first cooling section is configured to receive heat from the first flywheel bearing and the second cooling section is configured to receive heat from the second flywheel bearing. Optionally, the pump is configured to pump the water back to the body of water. Optionally, the pump is a first pump and the cooling system further comprises a second pump that is configured to pump the water back to the body of water. Optionally, the first pump is located upstream of the marine gyroscopic stabilizer and the second pump is located downstream of the marine gyroscopic stabilizer. Optionally, the pump is configured to pump the water into a reservoir after the water cools the marine gyroscopic stabilizer. Optionally, the pump is a first pump and the cooling system further comprises a second pump that is configured to pump the water in the reservoir back to the body of water. Optionally, the cooling system comprises a tell-tale outlet configured to dispense water from the open loop circuit above a waterline of the body of water to visually indicate operation of the pump. Optionally, the cooling system comprises a drain outlet configured to facilitate draining of the water from the cooling system.

In non-limiting examples, a method for cooling a marine gyroscopic stabilizer of a marine vessel includes mounting the marine gyroscopic stabilizer to the marine vessel, pumping water from a body of water in which the marine vessel is operating through an open loop circuit that extends through the marine gyroscopic stabilizer, and exchanging heat between the marine gyroscopic stabilizer and the water passing through the open loop circuit.

Optionally, the method includes draining the water from the marine gyroscopic stabilizer. Optionally, the method includes routing the open loop circuit through a cooling section of the marine gyroscopic stabilizer which is configured to exchange heat with a flywheel bearing for rotatably mounting a flywheel assembly of the marine gyroscopic stabilizer. Optionally, the method includes routing the open loop circuit through a second cooling section of the marine gyroscopic stabilizer which is configured to exchange heat with a second flywheel bearing for rotatably mounting the flywheel assembly of the marine gyroscopic stabilizer. Optionally, the second cooling section is located downstream from the first cooling section such that the water passes through the first cooling section before passing through the second cooling section. Optionally, the method includes pumping the water to a reservoir after the water cools the marine gyroscopic stabilizer. Optionally, the method includes pumping the water in the reservoir back to the body of water.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A marine vessel comprising:

a marine gyroscopic stabilizer; and a cooling system configured to cool the marine gyroscopic stabilizer, the cooling system having:

an open loop circuit extending through the marine gyroscopic stabilizer; and a pump configured to pump water from a body of water in which the marine vessel is operating through the open loop circuit such that the water cools the marine gyroscopic stabilizer.

2. The marine vessel according to claim 1, wherein the marine gyroscopic stabilizer has a cooling section through which the water flows to cool the marine gyroscopic stabilizer, and wherein the cooling section is configured to facilitate draining the water therefrom.

3. The marine vessel according to claim 2, wherein the cooling section has a sloped surface configured to facilitate draining of the water from the marine gyroscopic stabilizer.

4. The marine vessel according to claim 2, wherein the cooling section is a first cooling section, and the marine gyroscopic stabilizer further comprises a second cooling section separate from the first cooling section through which the water flows to cool the marine gyroscopic stabilizer, and wherein the second cooling section is configured to facilitate draining the water therefrom.

5. The marine vessel according to claim 4, wherein the second cooling section is located downstream from the first cooling section such that the water passes through the first cooling section before passing through the second cooling section.

6. The marine vessel according to claim 4, wherein the marine gyroscopic stabilizer has a first flywheel bearing and a second flywheel bearing; and wherein the first cooling section is configured to receive heat from the first flywheel bearing and the second cooling section is configured to receive heat from the second flywheel bearing.

7. The marine vessel according to claim 1, wherein the pump is configured to pump the water back to the body of water.

8. The marine vessel according to claim 1, wherein the pump is a first pump and the cooling system further comprises a second pump that is configured to pump the water back to the body of water.

9. The marine vessel according to claim 8, wherein the first pump is located upstream of the marine gyroscopic stabilizer and the second pump is located downstream of the marine gyroscopic stabilizer.

10. A marine vessel comprising:

a marine gyroscopic stabilizer; and a cooling system configured to cool the marine gyroscopic stabilizer, the cooling system having:

an open loop circuit, and a pump configured to pump water from a body of water in which the marine vessel is operating through the open loop circuit such that the water cools the marine gyroscopic stabilizer, wherein the pump is configured to pump the water into a reservoir after the water cools the marine gyroscopic stabilizer.

11. The marine vessel according to claim 10, wherein the pump is a first pump and the cooling system further comprises a second pump that is configured to pump the water in the reservoir back to the body of water.

12. A marine vessel comprising:

a marine gyroscopic stabilizer; and a cooling system configured to cool the marine gyroscopic stabilizer, the cooling system having:

an open loop circuit, and a pump configured to pump water from a body of water in which the marine vessel is operating through the open loop circuit such that the water cools the marine gyroscopic stabilizer, wherein the cooling system comprises a tell-tale outlet configured to dispense water from the open loop circuit above a waterline of the body of water to visually indicate operation of the pump.

13. The marine vessel according to claim 1, wherein the cooling system comprises a drain outlet configured to facilitate draining of the water from the cooling system.

14. A method for cooling a marine gyroscopic stabilizer of a marine vessel, the method comprising:

mounting the marine gyroscopic stabilizer to the marine vessel;

pumping water from a body of water in which the marine vessel is operating through an open loop circuit that extends through the marine gyroscopic stabilizer; and exchanging heat between the marine gyroscopic stabilizer and the water passing through the open loop circuit.

15. The method according to claim 14, further comprising draining the water from the marine gyroscopic stabilizer.

16. The method according to claim 14, further comprising routing the open loop circuit through a cooling section of the marine gyroscopic stabilizer which is configured to exchange heat with a flywheel bearing for rotatably mounting a flywheel assembly of the marine gyroscopic stabilizer.

17. The method according to claim 16, wherein the cooling section is a first cooling section and the flywheel bearing is a first flywheel bearing, and further comprising further routing the open loop circuit through a second cooling section of the marine gyroscopic stabilizer which is configured to exchange heat with a second flywheel bearing for rotatably mounting the flywheel assembly of the marine gyroscopic stabilizer.

18. The method according to claim 17, wherein the second cooling section is located downstream from the first cooling section such that the water passes through the first cooling section before passing through the second cooling section.

19. The method according to claim 14, further comprising pumping the water to a reservoir after the water cools the marine gyroscopic stabilizer.

20. The method according to claim 19, further comprising pumping the water in the reservoir back to the body of water.

* * * * *